US009080345B2

(12) United States Patent
Krummenacher

(10) Patent No.: US 9,080,345 B2
(45) Date of Patent: Jul. 14, 2015

(54) BIVOUAC SHELTER

(75) Inventor: Walter Krummenacher, Bassersdorf (CH)

(73) Assignee: POLARMOND AG, St. Gallen (CH)

( * ) Notice: Subject to any disclaimer, the term of this patent is extended or adjusted under 35 U.S.C. 154(b) by 65 days.

(21) Appl. No.: 13/979,443

(22) PCT Filed: Jan. 5, 2012

(86) PCT No.: PCT/CH2012/000001

§ 371 (c)(1),
(2), (4) Date: Jul. 12, 2013

(87) PCT Pub. No.: WO2012/094769

PCT Pub. Date: Jul. 19, 2012

(65) Prior Publication Data

US 2013/0298477 A1 Nov. 14, 2013

(30) Foreign Application Priority Data

Jan. 14, 2011 (CH) ..... 0065/11

(51) Int. Cl.
*E04H 15/20* (2006.01)
*A47G 9/08* (2006.01)

(52) U.S. Cl.
CPC ..... *E04H 15/20* (2013.01); *A47G 9/086* (2013.01); *E04H 2015/205* (2013.01); *E04H 2015/207* (2013.01); *E04H 2015/208* (2013.01)

(58) Field of Classification Search
CPC ..... E04H 15/36; E04H 15/04; E04H 15/20; E04H 15/30; E04H 15/56; E04H 2015/205; E04H 2015/207; A47G 9/08; A47G 9/086
USPC ..... 135/87, 95–97, 137, 116, 119; 5/413 R, 5/413 AM, 414, 484; 2/69.5
See application file for complete search history.

(56) References Cited

U.S. PATENT DOCUMENTS

| | | | | |
|---|---|---|---|---|
| 1,699,002 | A * | 1/1929 | Leibold | 5/413 R |
| 2,656,844 | A | 10/1953 | Kreuzer | |
| 3,840,919 | A | 10/1974 | Middleton | |
| 3,959,834 | A | 6/1976 | Hunt | |
| 4,109,424 | A | 8/1978 | Block | |
| 4,192,030 | A | 3/1980 | Casson | |

(Continued)

FOREIGN PATENT DOCUMENTS

| | | |
|---|---|---|
| AU | 38202/85 | 1/1985 |
| CH | 207621 | 11/1939 |

(Continued)

*Primary Examiner* — Winnie Yip
(74) *Attorney, Agent, or Firm* — Rankin, Hill & Clark LLP

(57) ABSTRACT

A bivouac shelter for residing outdoors, including a basis unit that forms a tunnel-like or sack-like body receiving space with an access opening for a person. The bivouac shelter includes a closure unit, by way of which the body receiving space is closable in a thermally insulating and airtight manner. The closure unit moreover includes a connection body that can be assembled transversely over the access opening and that is connectable to the basis unit in a thermally insulating manner. The closure unit moreover includes a hood attached onto the connection body for receipt of a head of a person lying with the body in the body receiving space. The basis unit can also include a foot-side terminating element.

15 Claims, 7 Drawing Sheets

(56) References Cited

U.S. PATENT DOCUMENTS

| | | | | | |
|---|---|---|---|---|---|
| 4,237,914 | A | | 12/1980 | Gantz | |
| 4,484,362 | A | * | 11/1984 | Asher | 2/69 |
| 4,531,330 | A | | 7/1985 | Phillips | |
| 4,605,029 | A | | 8/1986 | Russell | |
| 4,607,655 | A | | 8/1986 | Wagner et al. | |
| 4,716,918 | A | * | 1/1988 | Hayashida et al. | 135/93 |
| 4,757,832 | A | * | 7/1988 | Russell | 135/128 |
| 4,872,470 | A | | 10/1989 | Hayashida et al. | |
| 5,217,034 | A | * | 6/1993 | Yih et al. | 135/90 |
| 5,528,779 | A | | 6/1996 | Lee et al. | |
| 5,630,296 | A | | 5/1997 | Kendall, Jr. | |
| 5,642,750 | A | | 7/1997 | Brown et al. | |
| 5,699,820 | A | * | 12/1997 | Evans et al. | 135/96 |
| 6,351,851 | B1 | * | 3/2002 | Yardan | 2/89 |
| 6,671,903 | B2 | * | 1/2004 | Bowers et al. | 5/413 R |
| 2002/0162584 | A1 | | 11/2002 | Berman | |
| 2003/0003840 | A1 | | 1/2003 | Hsu et al. | |
| 2004/0025929 | A1 | | 2/2004 | Turner | |
| 2004/0040087 | A1 | | 3/2004 | Lack et al. | |
| 2006/0021139 | A1 | | 2/2006 | LaVigne | |
| 2007/0028952 | A1 | | 2/2007 | Woodruff et al. | |
| 2008/0047061 | A1 | * | 2/2008 | Peck | 5/413 AM |
| 2008/0209609 | A1 | * | 9/2008 | Panek | 2/66 |
| 2010/0083995 | A1 | | 4/2010 | Sanders | |
| 2010/0154852 | A1 | | 6/2010 | Trieu | |
| 2012/0125390 | A1 | * | 5/2012 | Damas | 135/115 |

FOREIGN PATENT DOCUMENTS

| | | |
|---|---|---|
| CH | 610743 | 5/1979 |
| CN | 2194133 | 4/1995 |
| CN | 2330740 | 7/1999 |
| CN | 2431799 | 5/2001 |
| CN | 2571936 | 9/2003 |
| CN | 2887156 | 4/2007 |
| DE | 202004001375 | 8/2004 |
| DE | 202004009783 | 5/2005 |
| FR | 2481589 | 11/1981 |
| JP | 2005213701 | 8/2005 |
| WO | 82/03001 | 9/1982 |
| WO | 94/17266 | 8/1994 |
| WO | 2004/109041 | 12/2004 |
| WO | 2006/104567 | 10/2006 |
| WO | 2008/025038 | 2/2008 |

* cited by examiner

BIVOUAC SHELTER

BACKGROUND OF THE INVENTION

1. Field of the Invention

The invention relates to a bivouac shelter for residing outdoors or in non-heated accommodation, said bivouac shelter comprising a basis unit which forms a tunnel-like or tube-like body receiving space with a foot region as well as with at least one access opening for at least one person.

Bivouac shelters provide a person with protection from weather conditions when residing outdoors. Such weather conditions can be wind, downpour, such as snow, hail or rain, as well as temperature conditions. Bivouac shelters in particular should also serve for permitting spending the night outdoors and provide a sleeping person with adequate protection from the mentioned weather conditions. Bivouac shelters are used by the most varied of groups of people. Of course, the use of bivouac shelters for outdoor activities such as trekking, mountain tours, expeditions etc. are known. Here, the bivouac shelters permit the stopover over several days, in regions, in which no fixed sheltered accommodation is otherwise available. Moreover, bivouac shelters are also applied for homeless people who for various reasons permanently or temporarily have no fixed accommodation. These can be persons who can no longer live in their fixed accommodation due to the event of damage, such as with earthquakes, fire, flooding or storms. Moreover, the homelessness can also relate to refugees who had to leave their fixed accommodation for various reasons. Moreover, bivouac shelters are also used by emergency services, such as the military with their deployment lasting several days, in regions in which no fixed sheltered accommodation is available and where mobility is highly important. Bivouac shelters are also used in the field of rescue.

Known to a lesser extent is the provision of bivouac shelters to homeless people whom one comes across in large cities and who cannot afford fixed accommodation due to economic reasons for example. This type of homeless people either spends the night out in the open in self-constructed, makeshift dwellings or in overnight shelters for the homeless. It is particularly the case in harsh winters that such overnight shelters are however fully occupied, so that indeed with freezing temperatures many homeless people must spend the night in their makeshift dwellings or at locations out in the open which provide a little shelter. These opportunities for spending the night however provide much too little protection from the weather conditions and in particular low temperatures, so that it is indeed in harsh winters that death and freezing often occurs amongst the homeless.

2. Description of Related Art

Apart from bivouac shelters, sleeping bags are also known for spending the night out in the open, and these are to insulate the body against low outside temperatures. Such sleeping bags are disclosed for example in US 2004/0040087 and U.S. Pat. No. 3,959,834A. The body with such sleeping bags however is not hermetically sealed to the outside, since the head lies outside the sleeping bag and air can therefore circulate through the head opening. The head and in particular the face portion as a rule are insufficiently protected from low temperatures, even if integrated hoods are provided for this. Although it is known to span hood coverings over the head for the reasons mentioned above, this solution is likewise not satisfactory since such hood coverings e.g. are not windproof.

In contrast to the conventional sleeping bags mentioned above, bivouac shelters also provide protection from further weather influences such as wind and downpour. A multitude of bivouac shelters for residing outdoors is known from the state of the art. Thus e.g. WO 2004/109041 describes a mobile protective shelter with an inflatable element. The protective shelter forms a tunnel-like cavity which can provide a lying person with protection and can be closed off to the outside. According to this sheltering device, the complete person is located in the tunnel-like cavity, so that a separate air feed is provided, via which the person is supplied with air for breathing. In another example, the person is supplied with oxygen by an oxygen bottle brought along.

WO94/17266 describes an inflatable sheltering device with an inflatable mattress and, arranged above this, a likewise inflatable cover hood which together with the mattress forms a cavity for completely receiving a person. Air openings are provided for the supply of fresh air.

In certain embodiments of bivouac shelters, the head therefore in each case together with the remaining body is accommodated in a thermally insulating receiving space. This however necessitates the provision of means for the fresh air supply such as e.g. air openings. Moreover, air openings must also be provided in order to prevent the formation of condensation water in the receiving space due to exhaled air. Such air openings however reduce the heat insulation capacity and are moreover problematic with regard to their sealedness with respect to water, such as rain, or surface water. Other means for the supply of fresh air are also elaborate and complicated with regard to their implementation.

According to alternative embodiments of bivouac shelters, the head is arranged outside the thermally insulating receiving space for the body. The supply of breathing air is therefore ensured. Instead, the thermal insulation capacity is likewise reduced by way of leaky or permeable transition region between the outer-lying head portion and the remaining body. Moreover, the head portion is insufficiently protected from the influences of the weather.

BRIEF SUMMARY OF THE INVENTION

It is therefore the object of the invention, to provide a mobile and lightweight bivouac shelter of the initially mentioned type, with which on the one hand the body is ideally protected from weather influences and in particularly optimally thermally insulated from the cold, and on the other hand the adequate supply of fresh air for breathing is ensured without complicated technical measures. The bivouac shelter should moreover be simple with regard to design and assembly, as well as inexpensively manufacturable.

This object is achieved by the characterising features of claim 1. The dependent claims claim particular further developments and alternative solutions of the invention.

The bivouac shelter is thus characterised in that the basis unit comprises a connection opening for a closure unit, said connection opening lying opposite the foot region. The basis unit is moreover designed in a self-supporting manner in the operating position and forms a shape-retaining body receiving space. The basis unit moreover comprises an at least partially, preferably completely multi-walled construction with at least one, preferably a plurality of air-filled hollow chambers lying therebetween, wherein the basis unit obtains its intrinsic stability due to the multi-walled construction.

According to a particular embodiment, the basis unit comprises an inner (insulating) body as well as an outer (insulating) body. The outer body bears on the inner insulating body and envelops this at least partly and preferably completely. The outer body in particular forms a tunnel-like or tubular receiving space for the inner body. The inner body for its part forms a tunnel-like or tubular body receiving space.

The inner body can e.g. be inserted into the outer body. The two insulating bodies moreover form a ground part.

Hollow chambers which are closed or connected to one another and are preferably air-filled are arranged between the two insulating bodies. These hollow chambers have a further insulation effect. For this, the inner body towards the outer body, and/or the outer body towards the inner body preferably has an outer contour with prominences and recesses. The outer contour can e.g. be wavelike, zigzagged, and in particular square-wave-shaped.

Both bodies are preferably designed in a multi-walled manner, with one or more air-filled hollow chambers lying therebetween. The bodies for this contain valves, with which the hollow chambers can be filled with air.

In a further development of the invention, the closure unit is attached onto the connection opening in a releasable or fixed manner and closes the body receiving space in a thermally insulating manner.

The connection opening preferably corresponds to an end-side opening of the tunnel-like or tubular body receiving space.

According to a particularly preferred embodiment, the connection opening corresponds to the access opening. This does not necessarily need to be the case. Thus the access opening can also be attached or incorporated laterally, on a wall section which laterally delimits the body receiving space in the longitudinal direction. The access opening here can e.g. be designed as an access slot or access gap or by way of a detachable access flap which forms hatch. The access slot or access gap are arranged e.g. in the longitudinal direction.

Moreover, the access opening can also be designed by a liftable basis upper part. The basis upper part can be completely separated from the remaining basis unit or be connected to this via a hinge connection. The basis upper part can be connected to the lower part of the basis upper part via a tongue-and-groove connection which is at least partly peripheral.

The access opening defines that opening, through which the user enters into the body receiving space.

The closure unit is releasably connected to the basis unit via closure means, such as with a positive fit, a friction fit, in particular via a Velcro-type closure, zip closure or button closure.

The closure unit can comprise a connection body which can be assembled transversely over the connection opening or access opening and which is connectable to the basis unit in a thermally insulating manner.

Moreover, the closure unit preferably comprises a hood for receiving a head of a person lying with his body in the body receiving space, said hood being attached in a releasable manner or in non-releasable manner which is to say integrally. The hood preferably comprises a flexible two-dimensional (sheet-like) material.

The body receiving space is closable preferably in a thermally insulating as well as watertight and/or airtight manner by way of the closure unit. Watertight means that no moisture and in particular no rainwater or surface water can penetrate into the body receiving space. Airtight means that no uncontrolled exchange of air can take place, wherein an air exchange controlled by valves is not to be excluded by this.

The closure unit is thus preferably connectable via the connection body to the basis unit, preferably in an airtight, watertight and thermally insulating manner. Accordingly of course, the basis unit or its wall region is also designed in a thermally insulating and preferably also airtight as well as watertight manner. The body receiving space serves for receiving at least the legs or parts thereof and preferably the torso as well as the arms and legs of a lying person, hereinafter called body. The head in contrast is placed outside the body receiving spaced closed by the closure unit.

The thermally insulated body receiving space is heated up by the body's own heat of the person lying therein, and is kept warm. I.e., no external heat source such as a heater is necessary for heating the body receiving space. With particularly harsh weather conditions, additional heating means can be provided in the body receiving space for heating this. Since the body receiving space is however hermetically closed to the outside and permits no air circulation and moreover is thermally insulated in an optimal manner by the air chambers of the basis unit, the body receiving space can be kept comfortably warm with a comparatively low heat output. Moreover, additionally a sleeping bag or a sleeping envelope or a sleeping cover arranged in the body receiving space and for increasing the comfort can be provided. The sleeping bag or the sleeping envelope can e.g. be releasably or non-releasably connected to the closure unit.

The basis unit preferably at least in sections and preferably completely or over the whole periphery is designed in a multi-walled, in particular double-walled manner. The basis unit thus comprises at least two walls which are distanced to one another. At least one, preferably several hollow chambers which are separated from one another and are filled with air (e.g. inflatable) is contained therebetween in a lying manner. The chambers e.g. are inflatable via one or more valves e.g. by way of a pump such as a hand pump or foot pump, with a gas such as air. The chambers can also be self-inflatable. Inflatable is therefore to be understood hereinafter as self-inflatable as well as actively inflatable, e.g. by way of a pump.

The chambers can be separated from one another in an airtight manner or designed in a manner communicating with one another. The hollow chambers which are formed between the outer wall and the inner wall and which are filled with air ensure an optimal thermal insulation of the bivouac shelter with respect to the environment.

The basis unit likewise forms the ground part which lies on the ground and which is usefully an integral part of the basis unit. This ground part is usefully likewise designed in a multi-walled manner with hollow chambers which are filled with air (e.g. inflatable) and lie therebetween, and therefore simultaneously also assumes the function of a mattress. I.e. the ground part with the air-filled hollow chamber(s) not only serves for the thermal insulation but also for cushioning or spring support.

According to a first embodiment variant, the multi-walled construction of the basis unit comprises two outer-lying walls as well as a self-expanding inner structure lying therebetween and having at least one hollow chamber. The inner structure is elastically expandable into an operating position e.g. by way of pressure relief. The air is sucked through a valve by way of this. The filling of the hollow chambers with air is thus effected without the active supply of air. The inner structure can e.g. contain an elastically deformable foam material. The hollow chambers here are formed by the pores of the foam material. The shape retention is effected here essentially via the inner structure, e.g. the foam and not necessarily via the enclosed air volume. The air according to this embodiment variant specifically usefully has atmospheric pressure.

In the transport condition, the basis unit is folded or rolled in a compact manner, and well as the air pressed out of the hollow chambers. The inner structure experiences a compression in this condition. Only on unfolding or unrolling and the pressure relief entailed by this does the basis unit begin to automatically inflate with air through the valves.

According to a second embodiment variant, the multi-walled construction of the basis unit comprises two outer-lying walls as well as flexible connection webs or chamber walls which lie therebetween and which connect the two walls to one another. The connection webs or chamber walls are a type of spacer between the walls which are connected to these. They form one or more open or closed hollow chambers which can be filled with air via one or more valves. The hollow chambers here must be actively inflated. The shape retention is effected here essentially via the air volume enclosed in the hollow chambers. The air according to this embodiment variant specifically preferably has an overpressure compared to the ambient pressure.

Whilst the ground part is preferably designed in a plane manner, the roof part arranged thereabove is preferably formed in an arched manner. The roof part can however also be designed differently, e.g. with plane surfaces which meet at an angle. The roof part with its lateral wall sections is connected to the ground part, preferably in an integral manner. The roof part can moreover comprise reinforcement structures which are separate or integrated into this, and which ensure the intrinsic stability of the basis unit.

The basis unit can be designed as a plane component which is flexible in the inflated condition and which can be bent into a tubular structure for creating the bivouac shelter, wherein the two lateral end sections or end edges which are led together are connected to one another in a thermally insulating and preferably also watertight and/or airtight manner.

The basis unit comprises a foot region which lies opposite the connection opening. The body receiving space is terminated or closed off to the outside in a thermally insulating manner and preferably also in a watertight and/or airtight manner, in the foot region.

In a particular embodiment, a separately formed terminating element can be provided, via which the body receiving space in the foot region can be closed in a thermally insulating and preferably also watertight and/or airtight manner. The terminating element can be designed as a separate element which can be completely disassembled from the basis unit, or as an element which at least partly can be released from the basis unit amid the release of a connection opening to the outside. According to this embodiment, with a disassembled terminating element, warm air can be led into the body receiving space via the foot opening. The terminating element can be connected to the remaining basis unit via a type of tongue-and-groove connection designed in an annular and closed manner.

The terminating element can however also be designed as an integral, non-releasable part of the basis unit. The terminating element preferably at least in sections, preferably completely is likewise designed in a multi-walled manner, in particular in a double-walled manner. Preferably, one or more inflatable chambers for the thermal insulation of the body receiving space are formed between an outer wall and the inner wall. In a preferred embodiment of the invention, the basis unit, preferably together with the terminating element forms a body which over the whole periphery is designed in at least double-walled manner, with one or more inflatable chambers lying therebetween, for the thermal insulation of the body receiving space. This means that with the exception of connection webs which as the case may be are provided between the walls, a thermally insulating hollow chamber is always arranged between an inner wall and outer wall of the basis unit, as the case may be also of the terminating element.

The basis unit in the operating position is also designed in a self-supporting and intrinsically stable manner, and forms a tunnel-like or tubular permanent body receiving space, independently of whether a person is located thereon or not. The body receiving space in cross section can have any polygonal or round or other type of shape. The cross-sectional shape of the outer contour of the basis unit and/or its tunnel-like body receiving space can be polygon-shaped, e.g. triangle-shaped, rectangle-shaped, trapezium-shaped or semicircular. The basis unit can have a height reducing from the head region to the foot region. An aerodynamic design of the basis unit as well as of the tent structures such as awnings which belong thereto as the case may be, can be advantageous.

The closure unit is preferably designed as a separate element which can be partly or completely disassembled from the basis unit. One however can also envisage the closure unit being designed as an element which is at least partly separable from the basis unit amid the release of a connection opening or access opening. The closure unit must however be at least separable in a manner such that a person can move through the released connection opening or access opening, into the body receiving space.

The closure unit in a preferred development of the invention comprises a connection body which is designed in a peripheral and annular or bead-like manner, for connection to the basis unit. The connection body can be designed in a single-part or multi-part manner. The connection body can however also be a differently designed closure means, such as part of a zip closure, Velcro-type closure or button closure.

The closure unit moreover comprises a flexible, sheet-like sealing element which spans the opening outlined by the annular connection body for example. The sheet-like sealing element as the case may be is connected to the connection body preferably in a non-releasable and in particular watertight and/or airtight manner. The hood is moreover connected to the sheet-like sealing element in a releasable or non-releasable, i.e. integral manner.

The sheet-like sealing element and the hood are preferably manufactured of the same material and particularly preferably in a single-part manner.

The sheet-like sealing element and/or the hood are preferably manufactured from or with a single-layer or multi-layer material and particularly preferably from or with a textile sheet formation. In contrast to the basis unit, the sheet-like sealing element and/or the hood preferably have no inflatable chambers. The sealing element and/or the hood particularly preferably have elastically stretchable characteristics, and consist preferably of a natural or synthetic rubber or contain these. The sealing element and/or the hood particularly preferably consist of chloroprene rubber, or polychloroprene or chlorbutadiene rubber, as known under the trademark Neoprene® or contain these.

The sheet-like sealing element and/or the hood can also be of a double-layered or multi-layered textile material with chambers which are filled with an insulating solid matter material, such as downs, plastic foam or plastic fibres.

According to a particular embodiment of the invention, the upper part of the basis unit and thus also the connection opening is set back with respect to the ground part, in the direction of the foot region, in a manner such that the user with the closure unit formed as a connection element can assume an upright seated position in the basis unit. The legs thereby at least partly, preferably completely are accommodated in the tunnel-like receiving space. The upper body is preferably arranged outside the body receiving space.

The closure unit can in particular be designed for the use in the embodiment mentioned above, as a jacket-like connection element or sealing element in the form of a pull-over part for receiving the upper body. The jacket-like connection element further comprises arms for receiving the arms as well as a hood for receiving the head. The jacket-like connection element is designed as a type of sleeping envelope.

The jacket-like connection element can itself form a closable access, through which the user can enter into the jacket-like connection element as well as into the body receiving space. The closure of the access can be a zip closure, Velcro-type closure, button closure or a combined closure, which is incorporated into the connection element. The access can be slot-like or gap-like.

The jacket-like connection element can be connected to the basis unit in a fixed or integral manner, or in a releasable manner. The releasable connection can be a zip closure, a Velcro-type closure, button closure or a combined closure. The connection is accordingly designed in an annularly closed manner. In this case, the access into the body receiving space can be effected via this releasable connection. For this, the user firstly pulls over the jacket-like connection element, gets into the body receiving space and fastens the jacket-like connection element on the basis unit. Analogously to this, the jacket-like connection element can already be preassembled on the basis unit. In this case, the user opens the connection firstly partially, gets in and pulls over the jacket-like connection element and closes the connection.

The hood is preferably designed as a so-called balaclava, also called ski mask or slip-over hood. This is a hood enveloping the complete head and the neck and either leaves free only the face or only the eyes, mouth and nose, in a targeted manner. The balaclava thereby is connected to the sheet-like sealing element via the neck part. If the hood comprises rubber-elastic characteristics, then this is designed in a manner such that the hood bears on the contour of the head and, as the case may be, of the neck, in a tight or snug manner, so that the body receiving space with the body located therein, via the hood lying snugly on the head arranged outside the body receiving space, is closed to the outside in a sealed, in particular watertight and/or airtight manner. The hood thus seals the facial contours.

The annular connection body is preferably designed in a bead-like manner and particularly preferably forms one or more chambers which are inflatable via preferably at least one valve. The connection body in the operational position is preferably designed as a supporting or self-supporting element which serves as a support mount for the flexible, sheet-like sealing element. With an inflatable connection body, this preferably has the previously mentioned characteristics not until in the inflated condition. The connection body however can also contain foam or consist of this. The connection body can be connected to the remaining basis unit via a type of tongue-and-groove connection which is designed in an annular and closed manner.

The closure unit and, with it, the connection opening, preferably in the longitudinal direction are arranged in a manner displaced inwards, i.e. towards the foot region, so that an outer-lying tunnel-like receiving section is formed, in which the head inserted into the hood can be positioned. The receiving section can be open to the outside at the end side. However, it is also possible for the receiving section to be closed to the outside by way of a further closure element, even if not necessary in an airtight and watertight manner. This additional closure element can likewise be designed in an inflatable manner with suitable hollow chambers, or also consist of an awning.

The receiving section can also be characterised in that the upper part of the basis unit in the region of the receiving section is set back with respect to the ground part in the direction of the foot region, in a manner such that the user with or without the closure unit designed as a connection element can assume an upright sitting position on the ground part, wherein the legs are accommodated in the tunnel-like receiving space.

The closure unit preferably comprises gripper elements arranged towards the body receiving space, such as grips or straps, by way of which the person lying in the body receiving space can pull the closure unit inwards in the direction of the foot region and bring it into the closure position. The grip elements are preferably fastened on the connection body.

The closure unit is preferably connected to the basis unit via a friction fit connection and/or positive fit connection. The closure unit can e.g. be connected to the basis unit via a type of tongue-and-groove connection, wherein e.g. a part-peripheral or fully peripheral groove or recess is provided in the basis unit, into which groove the connection body engages in a partially peripheral or fully peripheral manner. Other thermally insulating and preferably also watertight and/or airtight connection types are also possible.

Means which on the one hand are water impermeable and on the other hand are vapour diffusion permeable can be provided on the basis unit and in particular in the closure unit, for leading away air humidity out of the body receiving space. This can e.g. be effected via water impermeable but vapour diffusion permeable membrane which is known per se. Thus e.g. the flexible sealing element can comprise such means or such a membrane.

The bivouac shelter is designed such that it can be assembled and disassembled for multiple use. The bivouac shelter after emptying the hollow chambers can be brought into a compact unit for the transport and the storage, thanks to the basis unit and, as the case may be, the connection body and terminating element, which are inflatable or fillable with air in a pressure-free manner. The bivouac shelter or its elements such as basis unit and closure unit achieve their intrinsic stability by way of the inflation and filling of these with air, and the design of air-filled hollow chambers. Basically, the chambers can of course also be filled with a gas or gas mixture other than air.

The basis unit, as the case may be, with the terminating element as well as with the connection body as the case may be, comprises a flexible, sheet-like, watertight and airtight and, as the case may be, also elastic and stretchable material. The material can e.g. contain a plastic, in particular PVC and/or a natural or synthetic rubber or consist of these. The mentioned material forms the outer-lying walls and, as the case may be, webs of the hollow chambers. The material preferably consists of a textile sheet formation or contains such. A fibre-reinforced, in particular carbon-fibre-reinforced plastic fabric can also be used as a material.

The bivouac shelter according to the invention is therefore of a comparatively low weight and thus is suitable for being carried by a person. The bivouac shelter in its operational position (without awning) can e.g. have a length of 1 to 3 m, a width of 0.4 to 2 m and a foot height and head height of 0.3 and 1 m respectively. If the bivouac shelter is to provide space for more than one person, then it is designed accordingly wider. The bivouac shelter can be deployed e.g. at temperatures from −40° to +70° and has a weight e.g. of less than 6 kg.

For application with high temperatures, e.g. in summer, the closure unit and, as the case may be, also the terminating element can be omitted, so that the person lies in a tunnel-like body receiving space which is open to the outside at one end or at both ends. The openings in the head region and/or foot region can be shielded to the outside by way of a suitable awning as a minimum weather protection, viewing protection and light protection. The connection locations of the awnings to the basis unit however are preferably designed in a watertight manner in each case. The awnings can be connected to the basis unit in a releasable or non-releasable manner, wherein in the latter case, the flexible textile sheet formation of the awnings can be folded or rolled together with the basis unit and stored away.

The bivouac shelter can be designed for one, two or as the case may be, also several persons. Thus the bivouac shelter can be designed e.g. for two or more than two persons. In a first variant, the bivouac shelter comprises connection openings or access openings which lie opposite one another and which are closable via suitable closure units of the described type. The persons here are arranged next to one another, but lying opposite one another in an alternating manner.

In a second variant, one or more closure units are arranged on only one side and the persons lie next to one another in an equally directed manner, The persons can be arranged e.g. parallel next to one another in both variants.

According to the two variants mentioned above, a common closure unit can be provided for in each case one, two, several or all persons of a bivouac shelter, wherein an individual hood is allocated to each person. Preferably however, an individual closure unit is provided for the individual access and leaving.

According to a third variant, the bivouac shelter in a plan view is designed in the shape of an open ring, wherein the open inner circle forms a common receiving section or open receiving sections in the form of segments which are at least partly separated from one another by way of separating elements. The body receiving space is designed in each case as a ring segment. The persons are arranged with the head to the inner circle and with the feet radially outwards. The bivouac shelter and its spatial elements can also differ from the circular shape and e.g. be designed in an oval or elliptical or polygonal, in particular rectangular manner.

According to the variants mentioned above, in each case an individual open receiving section which e.g. are spatially separated from one another via separation elements, can be provided for the head of the individual person. One can also envisage two, more or all persons of a bivouac shelter sharing a common, open receiving section.

Thanks to the bivouac shelter according to the invention, with the described closure unit, it is possible to keep the body of a person warm in a body receiving space which is extremely well thermally insulating and is preferably also watertight and/or airtight, whist the head is in contact with the environment and despite this is likewise well protected from the cold and other weather conditions. Thanks to the closure unit according to the invention, the body receiving space is hermetically closed to the outside despite the head being arranged outside. In particular, there are no regions, via which an air exchange between the body receiving space and the environment is possible, wherein this would compromise the insulation effect. Despite this, the user has a certain freedom of movement, since the flexible, and, as the case may, be elastically designed, sheet-like sealing element of the closure unit permits a rotation of be body between a belly position, back position and side position, as well as a displacement of the body along its longitudinal axis.

Since the head is preferably arranged in a tunnel-like receiving section, although being arranged outside the body receiving space, this despite this is minimally protected from weather influences. For the supplementary protection of the head e.g. from wind, downpour, but also from the incidence of light, the receiving section can be shielded to the outside via an awning. The user can additionally or alternatively use the body receiving space for depositing his personal belongings, such as clothes, provisions and valuables, since the self-supporting basis unit forms a permanent body receiving space. The belongings are particularly secure from theft during sleep, since these are hermetically shielded to the outside in the body receiving space. The awning in front of the outerlying receiving section, apart from an additional weather protection, viewing protection and light protection, also provides a protective space for personal belongings. As can be deduced from the embodiments mentioned above, the bivouac shelter thus simultaneously has the function of a sleeping bag with an integrated, air-filled mattress as well as the function of a bivouac and material store.

The bivouac shelter according to the invention is moreover assemblable in a rapid and simple manner, i.e. without particular prior knowledge, as well as without any tools. Only an air pump or compressed air cartridges for inflating the individual elements are to be recommended as the case may be. The bivouac shelter provides protection for at least one person as well as for personal objects. The access can be designed in a kneeling or crawling manner. The height of the body receiving space can be dimensioned such that a person can sit therein, which is an increase in comfort, in particular for summer operation when the closure unit is not envisaged.

The bivouac shelter can be applied for the initially mentioned application purposes. The bivouac shelter according to the invention can also serve as an emergency shelter for homeless people. Since the bivouac shelter is simple to handle, easily and compactly transportable and storable as well as inexpensive, this is also particularly suitable also for the application in troubled regions by charity organisations or for the homeless in urban areas. Moreover, the bivouac shelter is also suitable preferably for outdoor activities, in particular for ski tours, mountain climbers, hunters, wilderness adventurers, expeditions, for travels with a vehicle, for rescue deployment or for the military.

The bivouac shelter is multifunctional from a varied point of view. Thus e.g. it is suitable for sleeping, for warming up, as a provisional accommodation with privacy, as well as for the storage and for the protection of personal belongings. Moreover, the bivouac shelter is suitable for all seasons, by way of the amount of thermal insulation being able to be adapted to the prevailing outer temperatures by way of removing or adding closure elements. Moreover, shoulder straps can be provided on the basis unit, wherein a type of rucksack can which can be carried by way of the shoulder straps can be formed by way of folding up the basis unit in accordance with instructions.

Thus the bivouac shelter according to the invention is preferably constructed in a modular manner. Such a modular bivouac shelter as has been previously described in detail comprises a basis unit forming a body receiving space as well as an open receiving section.

The body receiving space and the open receiving section of the basis unit are coherent, so that the bivouac shelter can be used as an open camp.

The modular bivouac shelter further comprises a closure unit which is connectable to the basis unit and spatially delimits the body receiving space from the open receiving section, so that the bivouac shelter can be used as sleeping envelope.

Moreover, the bivouac shelter preferably also comprises a tent unit which in the assembled condition spans the open receiving section of the basis unit, so that the bivouac shelter can be used as a tent.

The features of the bivouac shelter described in detail in the description and its embodiment variants are likewise valid with regard to the claim of a modular bivouac shelter.

The bivouac shelter with a load is even capable of floating and can therefore be used as a type of raft or for crossing waters, thanks to the multi-walled design of the basis unit with air chambers lying therebetween.

BRIEF DESCRIPTION OF THE DRAWINGS

The subject matter of the invention is explained hereinafter in more detail by way of one preferred embodiment example which is represented in the accompanying drawings. There are shown schematically in.

The reference numerals used in the drawings and their significance are listed in a grouped manner in the list of reference numerals. Basically in the figures, the same parts are provided with the same reference numerals.

DETAILED DESCRIPTION OF THE INVENTION

Figure 1:
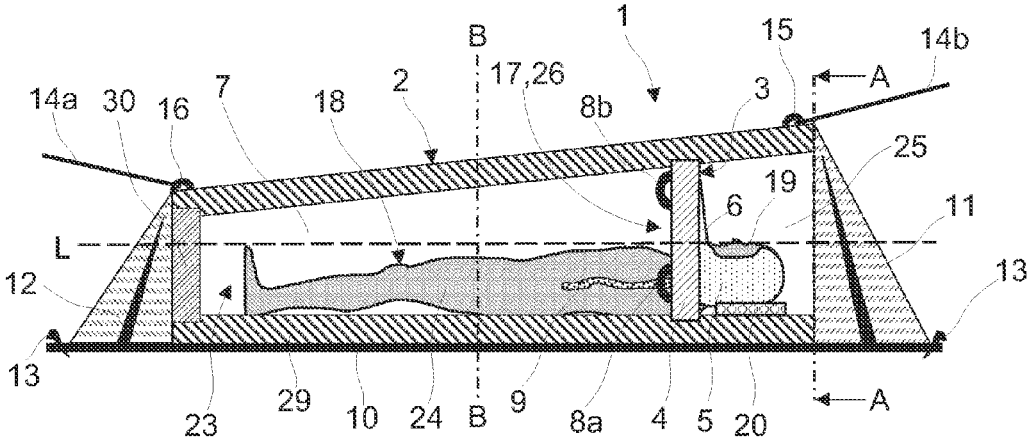
FIG. 1 is a longitudinal sectional elevation view of a first embodiment of a bivouac shelter according to the invention.

The bivouac shelter 1 according to the invention which is shown in FIGS. 1, 2 and 3*a*, 3*b* as an embodiment example comprises a basis unit 2 which forms a tunnel-like body receiving space 7. The basis unit 2 is thus designed in a tubular or tunnel-like manner. The basis unit 2 is designed in a double-walled manner of the complete periphery, with an outer-lying first wall 27 and an inner-lying second wall 28. Inflatable hollow chambers are arranged between the two walls 27, 28. As soon as the hollow chambers of the basis unit 2 are filled with air, these assume a self-supporting shape amid the formation of the mentioned body receiving space. It is of course self-evident that the shown basis unit 2 can generally be designed in a multi-walled manner with hollow chambers arranged in an infinitely suitable manner. A ground part 29 which is likewise designed in an at least double-walled manner with inflatable hollow chambers lying therebetween is integrated into the basis unit. The ground part 29 simultaneously serves as a mattress. The basis unit 2 lies with its ground part 29 lies on a ground underlay 10, for the protection from sharp objects. The ground underlay as a protection from damage can generally also be integrated into the ground part of the basis unit, or the ground part can be designed in a suitably reinforced manner towards the ground on its resting side.

The body receiving space 7 in the operational position forms a foot region 23 which is closed to the outside by way of a terminating element 30. The terminating element 30 is connected to the basis unit 2 in a thermally insulating and preferably airtight and/or watertight manner. The terminating element 30 is likewise designed in at least double-walled manner with inflatable hollow chambers lying therebetween.

A first awning 11 is fastened on the head-side end of the basis unit 2. A second awning 12 is fastened on the foot-side end of the basis unit 2. Both awnings 11, 12 are stentered via anchoring means such as tent pegs which are admitted in the ground. The first awning 11 in particular serves for the protection of an open receiving section 25 from wind, the incidence of light, rainfall, and as a viewing protection together with the basis unit 2 ensures a minimum of privacy. Both awnings 11, 12 further serve as storage space for personal belongings and provide a minimal of protection from the influences of the weather for these articles or also an animal such as a dog or cat.

The basis unit is additionally secured against dislocation via guy means 14*a*, 14*b* such as ropes or cables which are attached on the basis unit 2 via fastening loops 15, 16. The additional fastening serves for securing the bivouac shelter against strong winds, in particular when this is not being used and is therefore not weighed down by the weight of a person. The basis unit 2 can also be anchored on the ground (not shown) via anchoring elements. The guy means 14*a*, 14*b*, 15, 16 as well as the awnings 11, 12 as well as the anchoring elements 13 with the associated fastening means on the basis unit 2 are however optional features.

The bivouac shelter 1 does not lie directly on the ground. In contrast it is arranged on a ground underlay 10. The ground underlay 10 serves as a protection from damage to the basis unit 2 by sharp objects as well as for preventing the bivouac shelter 1 from getting dirty. The ground underlay 10 is also to repel moisture.

The basis unit 2, the terminating element 30 as well as the connection body 4 comprise valves, in particular check valves for inflating the mentioned parts (not shown).

According to the representation in FIG. 1, the body receiving space 7 of the basis unit 2 is closed off to the outside in a thermally insulating and airtight manner by way of a closure unit 3. The closure unit 3 for this is introduced transversely to the longitudinal direction L of the basis unit 2 and transversely to the connection and access opening 26, 27 in the direction of the body receiving space and closes the latter. The closure unit 3 is moreover arranged displaced towards the foot region 23 in the longitudinal direction L, so that an open, tunnel-like receiving section 25 which receives the head 19 of the user is formed.

The closure unit 3 comprises a connection body 4 which is designed in an annular manner and via which this closure unit with the basis unit 2 assumes the thermally insulating and, as the case may be, watertight and/or airtight connection. The connection body 4 is inflatable into a bead-like, self-supporting element and accordingly comprises one or more inflatable hollow chambers (not shown). The shape and size of the connection body 4 is usefully adapted to the inner cross-sectional contour of the tunnel-like access opening at the connection location.

A flexible, sheet-like sealing element 6 spans the opening outlined by the annular connection body 4 and is connected to the connection body 4 in an airtight manner. A hood 5 is integrated into the sheet-like sealing element. The hood 5 is designed as a balaclava which bears snugly on the head 19 and which completely covers the head 19 with the exception of the facial region, including the neck portion and in this manner keeps it optimally warm.

The sealing element 6 and the hood 5 preferably consist of the same rubber-elastically stretchable material. The sealing element 6 separates off the body receiving space 7 from the surroundings in an airtight manner, in the manner of a flexible, elastically stretchable membrane. The head region is also closed to the body receiving space 7 in an airtight manner since the hood integrated into the sealing element 6 is likewise designed with elastically stretchable characteristics, for a snug bearing on the head and as the case may be, the neck portion. This being the case despite the face positioned outside the body receiving space 7 being uncovered. The sealing element 6 in the present embodiment comprises a hand opening 21 which can be closed in a water-tight or airtight manner and through which the user can engage with the hand for the purpose of carrying out task such as eating or drinking. The hand opening 21 here can be closed e.g. by way of a zip closure.

A head underlay 20, e.g. a cushion, additionally supports the head 10 in the correct position. The head underlay 20 can be designed as a separate element or can be integrated into the ground part 29 of the basis unit 2 at a suitable location. The head underlay 20 preferably likewise contains one or more inflatable hollow chambers.

For setting up the bivouac shelter 2 and for creating the operating position, the basis unit 2, the terminating element 30 and the connection body 4 are inflated until the envisaged pressure is achieved in the air chambers. Subsequently, the terminating element 30 is assembled into the basis unit. For assuming the lying position for the purpose of sleeping or keeping the body warm, the person 18 concerned with his feet in front slips through the access opening 17, also called entry opening, into the body receiving space extending in the longitudinal direction. For the closure of the body receiving space 7 the person 18 grips the previously arranged closure unit 3 at the grips 8*a* . . . d with both hands and pulls the closure unit 3 over his head 19, so that the head comes to lie in the hood 5. Simultaneously or subsequently, the person 18 via the connection body 4 fixes the closure unit 3 in a connection section (not shown) provided especially for this, in the access opening 17. Of course, the person 18 can also insert the head 19 into the hood 5 not until after the fixation of the closure unit 3 in the envisaged position. Tightening means 9 are provided for this, via which the user 18 can pull the hood 5 over the head 19. The user 18 can optionally tighten the hood via the tightening means 9 or via a separate pull cord, on the chin.

Moreover, optionally a flexible tube with a check valve can be integrated into the closure unit 3 and in particular into the sealing element 6, via which tube the exhaled air heated by the body can be blown into the body receiving space 17 for the purpose of a quicker heating. The valve can be equipped with a filter unit for separating air moisture.

Figure 2:
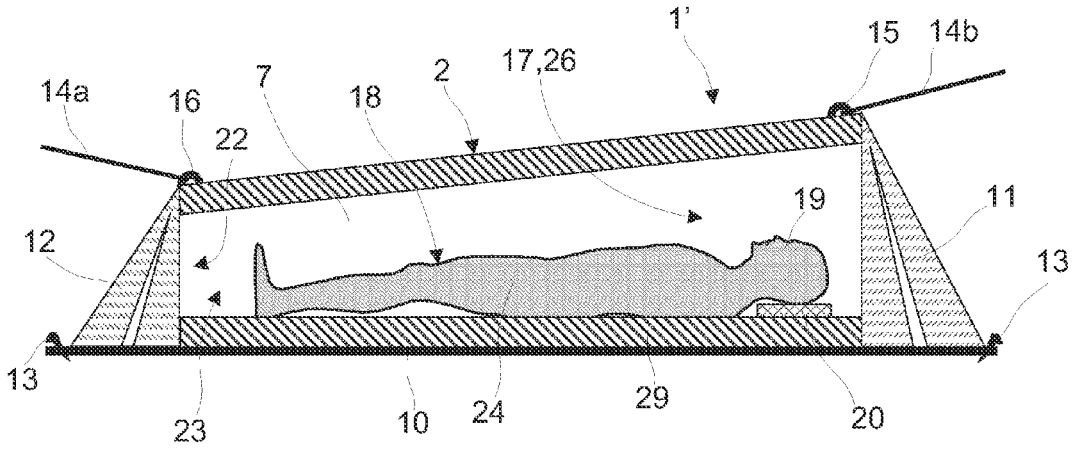
FIG. 2 is a longitudinal sectional elevation view through a bivouac shelter according to FIG. 1, for summer use.
Figure 3A:
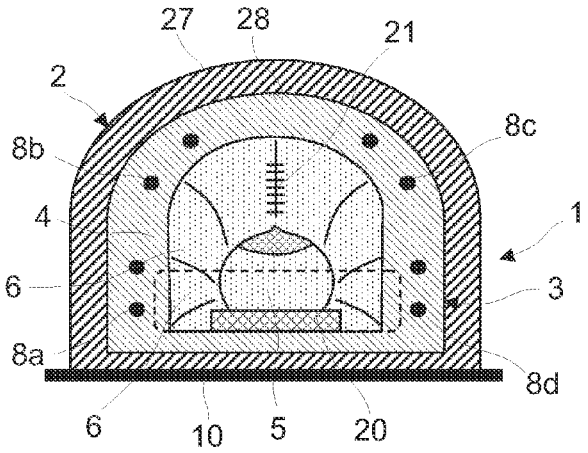
FIG. 3*a* is a sectional elevation view of the bivouac shelter according to the invention, in the direction of the connection opening or access opening (A-A) according to FIG. 1.
Figure 3B:
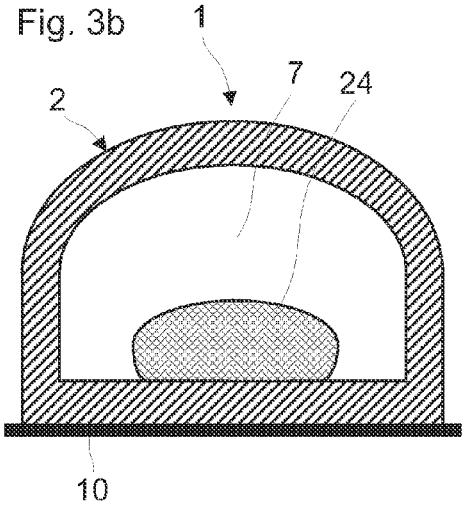
FIG. 3*b* is a cross-sectional elevation view along the line B-B according to FIG. 1.

The bivouac shelter 1' according to FIG. 1, as can be used in summer operation, which is to say at mild temperatures and friendly weather, is shown in FIG. 2. The terminating element 30 is separated from the basis unit 2, so that a foot-side opening 22 is released in the foot region 23. Moreover, the closure unit 3 is also removed, so that the access opening 17 is also open and the person 18 lies in an extended receiving space which apart from the body receiving space 17 also includes the receiving section 25. The extended receiving space which is open at both ends is well ventilated in this manner.

Figure 4:
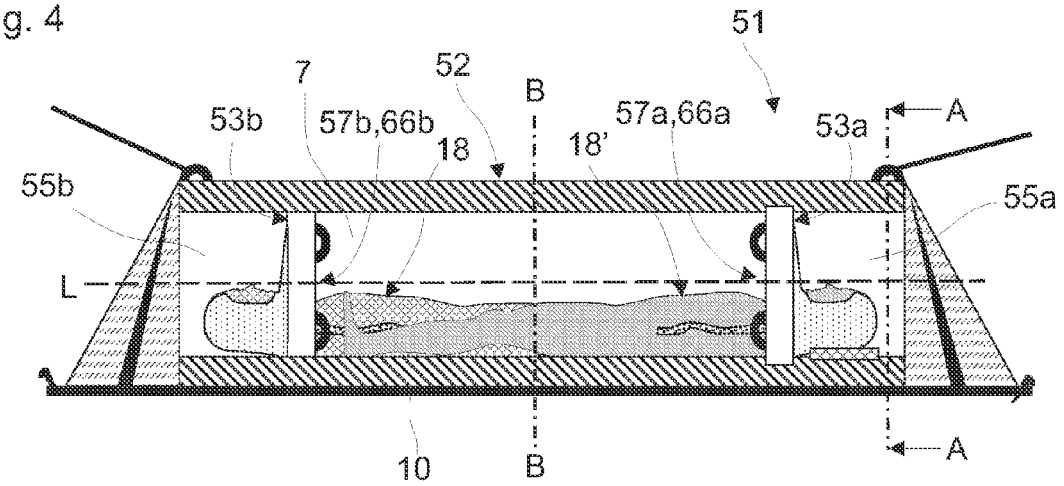
FIG. 4 is a longitudinal sectional elevation view through a further embodiment of a bivouac shelter according to the invention.

The embodiment of a bivouac shelter 51 according to FIG. 4 provides space for two persons. The bivouac shelter 51 likewise has a tunnel-like or tubular basis unit 52 of the described type, which forms a body receiving space 7 for two persons 18, 18'. The bivouac shelter 51 comprises two connection openings and access openings 66*a*, 66*b*, 57*a*, 57*b* which lie opposite one another and which are closable via suitable closure units 53*a*, 53*b* of the described type. The closure units 53*a*, 53*b* are likewise arranged in a manner displaced towards the oppositely lying access opening 57*a*, 57*b* in the longitudinal direction L, so that in each case an open, tunnel-like receiving section 55*a*, 55*b* which receives the head of the person 18, 18" is formed.

The persons 18, 18' are then arranged next to one another, but lying opposite one another in an alternating manner. Of course the bivouac shelter 52 can also be designed for more than two persons arranged next to one another in an alternate manner. Disregarding the modification or extension described above, the bivouac shelter 51 is provided with functionally equal elements as the bivouac shelter 1 according to FIG. 1, so that these elements are not further provided with reference numerals at this location.

Figure 5:
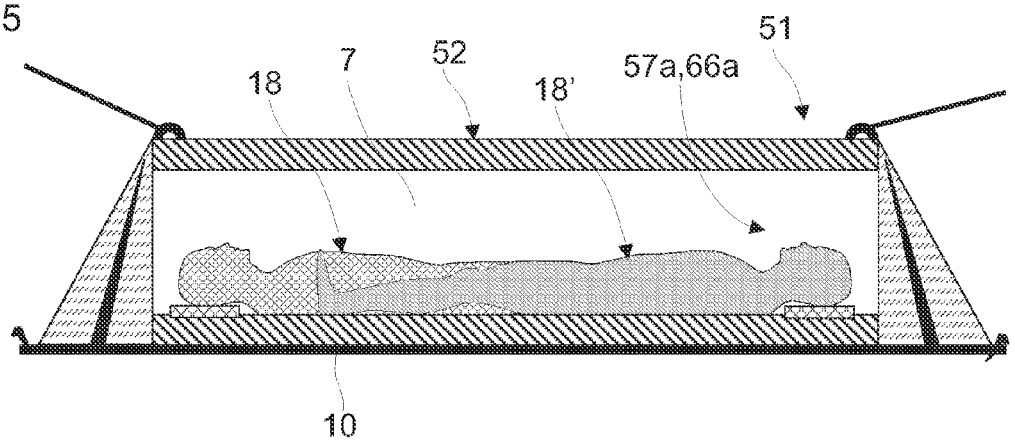
FIG. 5 is a longitudinal sectional view through the bivouac shelter according to FIG. 4, for summer use.

FIG. 5 shows the bivouac shelter 51 in summer operation which in contrast to the bivouac shelter for winter operation according to FIG. 4 amongst other things can be analogously retrofitted by way of removing the two closure units 53*a*, 53*b*, as with the bivouac shelter 1 according to FIGS. 1 and 2. Here too, a repeated explanation is therefore omitted at this location.

Figure 6A:
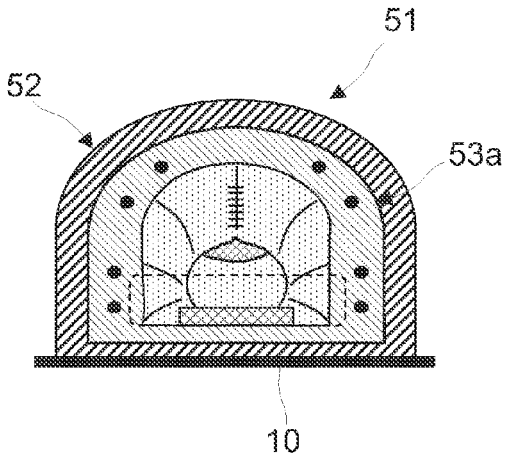
FIG. 6*a* is a sectional elevation view of the bivouac shelter according to the invention, in the direction of the connection opening or access opening (A-A) according to FIG. 1.
Figure 6B:
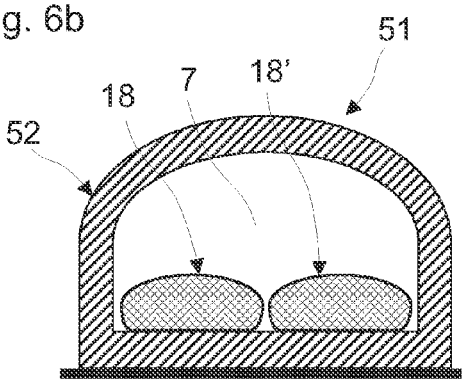
FIG. 6*b* is a cross-sectional elevation view along the line B-B according to FIG. 1.

FIG. 6*a* shows a front view of the bivouac shelter according to FIG. 4 (line A-A). A separate closure unit 53*a*, 53*b* is provided for the individual person. The FIG. 6*b* shows a cross section through the bivouac shelter according to FIG. 4 along the line B-B. The body receiving space 7 is designed such that two to four persons 18, 18' have enough space thereon. If e.g. a 4-some bivouac shelter is only used by 3 persons (or even less), then the non-used hood can be thermally optimally sealed by an inflatable balloon.

Figure 7:
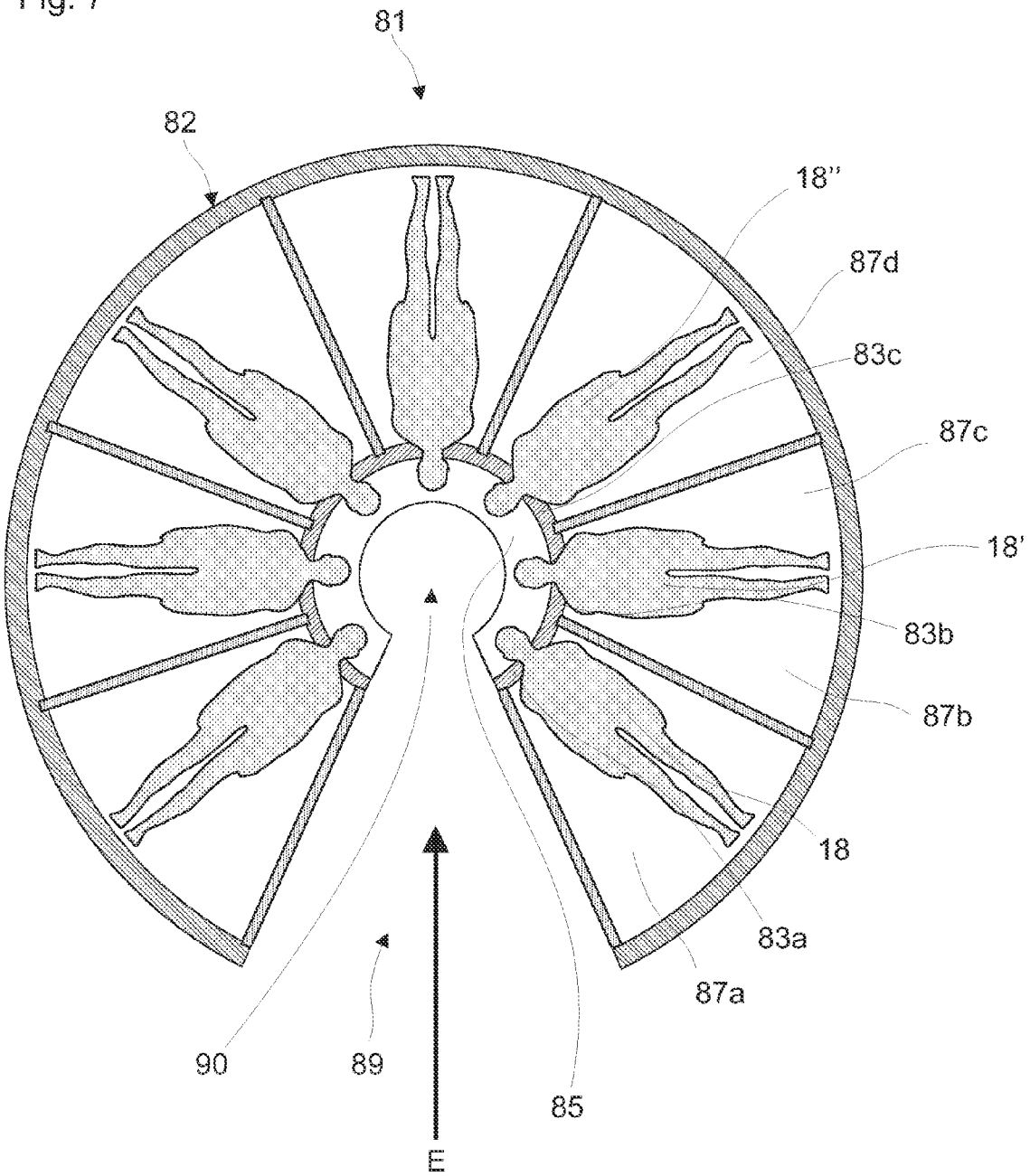
FIG. 7 is a plan view of a further embodiment of a bivouac shelter according to the invention.

A further embodiment of a bivouac shelter 81 for several persons is represented in FIG. 7. The bivouac shelter 81 in a plan view is designed in the shape of an open ring. The sector shaped recess 89 forms the common entry region E which leads into an inner circle 90 which is open at the top. The inner circle 90 forms a common, annular receiving section 85 which is open to the circle centre. This can also be divided up into individual sectors by way of e.g. radially arranged separation elements (not shown). The body receiving space 87*a* . . . *c* is designed in each case as a ring segment. The closure units 83*a* . . . *c* with the hoods which close the connection openings and access openings, are set back radially in the direction of the foot region, so that a channel-like receiving section 85 is formed with a channel opening directed to the middle point. The receiving section 85 is thus shielded to the top and to the bottom by the roof part and the ground part of the basis element 82 respectively. The persons 18, 18', 18" are arranged with the head to the inner circle 90 and with the feet radially outwards. The bivouac shelter 81 or at least the open inner circle 90 can be spanned with a tent roof (not shown). The closure units 83*a* . . . *c* as well as the basis unit 82 and any terminating elements (not shown), with regard to functioning are designed in an analogous manner to the corresponding elements of the other embodiments.

Figure 8A:
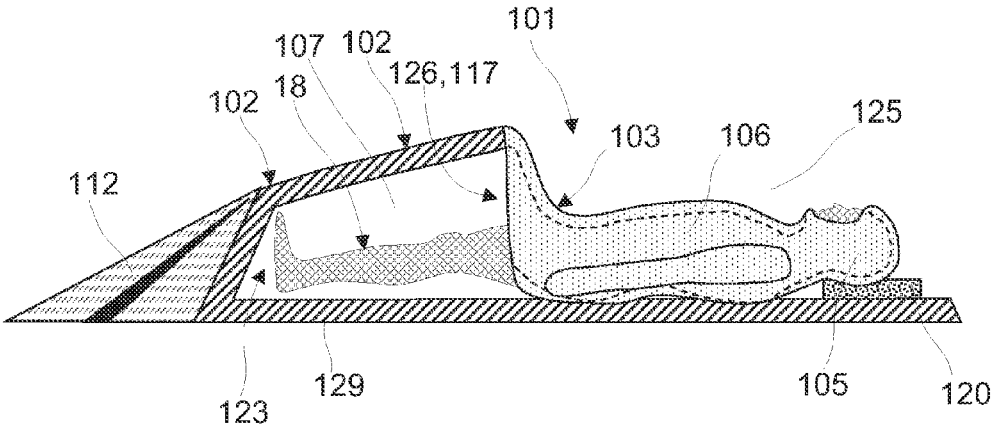
FIGS. 8*a*-8*c* are sectional elevation views of a further embodiment of a bivouac shelter according to the invention.
Figure 8B:
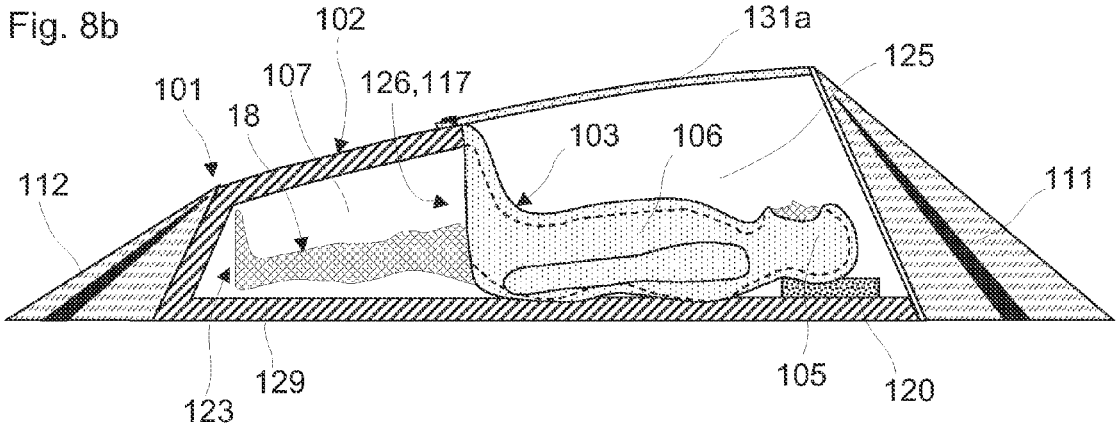
Figure 8C:
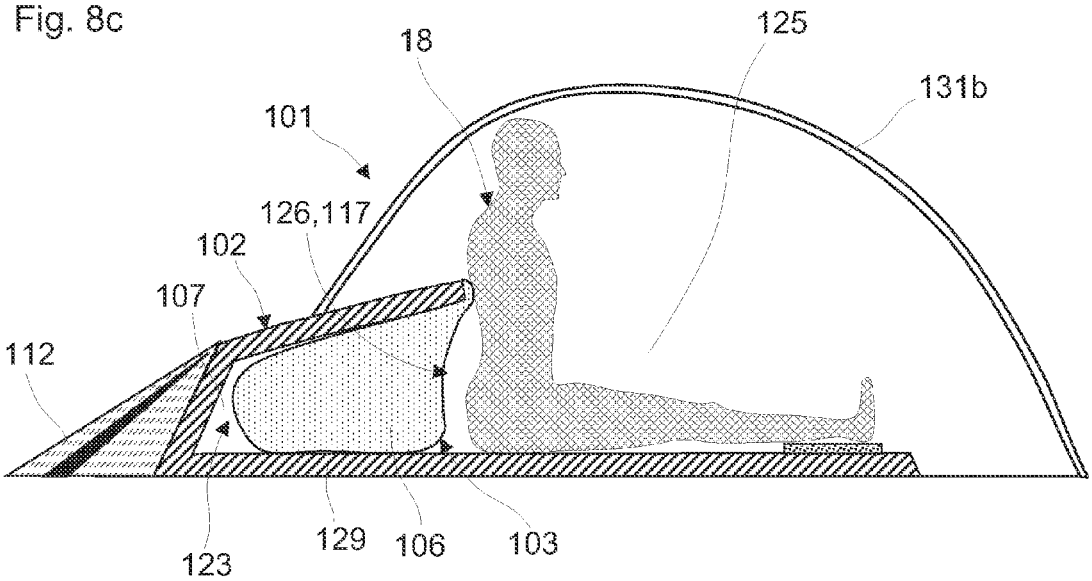

The bivouac shelter 101, 201, 251 represented in the FIGS. 8*a*-8*c* as well as 9*a*-9*c* comprises a basis unit 102, 202, 252 which forms a tunnel-like receiving space 107, 207. The basis unit 102, 202, 252 is likewise designed in a tubular or tunnel-like manner. The basis unit 102, 202, 252 is designed in a multi-walled, in particular double-walled manner over the whole periphery, with an outer-lying first wall and an inner-lying second wall. Hollow chambers fillable with air are arranged between the two walls. As soon as the hollow chambers of the basis unit 102, 202, 252 are filled with air, these assume a self-supporting, intrinsically stable shape amid the formation of the mentioned body receiving space 107, 207, 257. The shown basis unit 102, 202, 252 can have different, suitably designed hollow chambers.

The basis unit 102, 202, 252 moreover at the end of the tunnel-like or tubular receiving space 107, 207 which lies opposite the foot-side region forms a connection opening 126, 226, 276, onto which a closure unit 103, 203, 253 is integrally or releasably attached.

A ground part 129, 229, 279 which is likewise designed in a multi-walled, in particular double-walled manner, with air-fillable hollow chambers lying therebetween is also integrated into the basis unit. The ground part 129, 229, 279 simultaneously serves as a mattress.

The body receiving space 107, 207, 257 forms a foot region 123, 223, 273 in the operating position. Moreover, an awning 112, 212 can be fastened at the foot-side end of the basis unit 102, 202.

The basis unit 102, 202, 252 is secured on the ground preferably via suitable securing means as are already described in the context of the embodiment examples according to FIGS. 1 and 2.

The basis unit 102, 202, 252 moreover comprises one or more valves, in particular check valves, for filling the mentioned chambers (not shown).

According to the embodiment according to FIGS. 8*a*-8*c*, in the region of the receiving section 125, the upper part of the basis unit 102 is set back in the direction of the foot region 123 with respect to the ground part 129, in a manner such that the user 18 with the pulled-over closure unit 103 designed as a connection element 106, as described further below, can assume an uprightly seated position, wherein the legs are accommodated in the tunnel-like receiving space 107.

The connection opening 126 which simultaneously is the access opening 117 is accordingly arranged in the set-back end region of the tunnel-like body receiving space 107. The upper body thus lies out in the open (see FIG. 8*a*). The user can therefore also sit freely on the ground underlay 129 in the region of the basis unit 102 which is open to the top, wherein for this, the closure unit 103 which is not used can be pushed into the body receiving space 107 (see FIG. 8*c*).

The body receiving space 107 is closed off to the outside in a thermally insulating and airtight manner at the connection opening 126 by way of the closure unit 126. The closure unit 103 for this is arranged transversely to the longitudinal direction L of the basis unit 102 and transversely to the access opening 117 or connection opening 126.

Figure 8D:
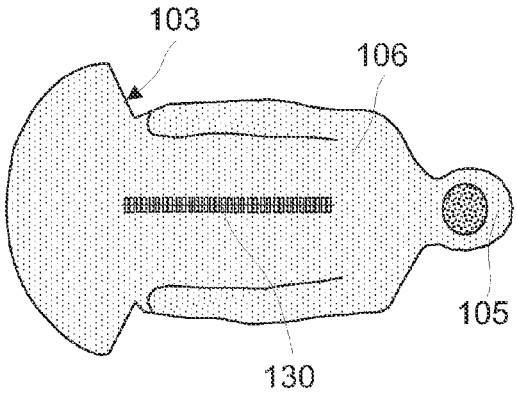
FIG. 8*d* is a plan view of an extended, sheet-like sealing element in a jacket design.

Since the tunnel-like body receiving space 107 is only designed for receiving the legs or parts thereof, the closure unit 103 is designed as a jacket-like connection element 106 of a flexible, sheet-like material, and comprises arms for receiving the arms, as well as a hood 105 (see FIG. 8*d*). Suitable, flexible sheet-like materials are already described for the embodiment according to FIGS. 1 and 2 as well as in the general description part.

The jacket-like connection element 106 can itself form a closable access 130, through which the user can get into the jacket-like closure element 106 as well as into the body receiving space 107. The closure of the access 130 can be a zip closure, Velcro-type closure, button closure or a combined closure. The access can be slot-like or gap-like. The ground part 129 extends up to the head portion of the jacket-like connection element 106. The head can be supported via a head underlay 120 which is separate or is integrated into the ground part 129.

The jacket-like connection element 106 can be connected to the basis unit 102 in a fixed which is to say integral manner, or in a releasable manner. The releasable connection can be a zip closure, Velcro-type closure, button closure or a combined closure. The connection is accordingly designed in an annularly closed manner. In this case, the access into the body receiving space can be effected via this releasable connection. For this, the user first pulls over the jacket-like connection element 106, gets into the body receiving space 107 and fastens the jacket-like connection element 106 on the basis unit 102.

The jacket-like connection element can however also be fastened on the basis unit in a fixed, i.e. non-releasable manner, so that the user gets in through an opening on the jacket-like connection element.

The region of the basis unit 102 which is open to the top and to the side and which forms an open receiving section 125, can be closed via a tent construction 131*a*, 131*b* (see FIGS. 8*b* and 8*c*). The tent construction 131*a*, 131*b* in particular ensures a light protection, viewing protection and wind protection and moreover protects from downpours. The tent construction 131*b* can e.g. form an arched dome so that the user 18 can also still sit upright when they tent construction 131*b* is assembled (see FIG. 8*c*). Moreover, an awning 111 can yet be provided on the head side, subsequently to the ground part 129 (see in particular FIG. 8*b*).

Figure 9A:
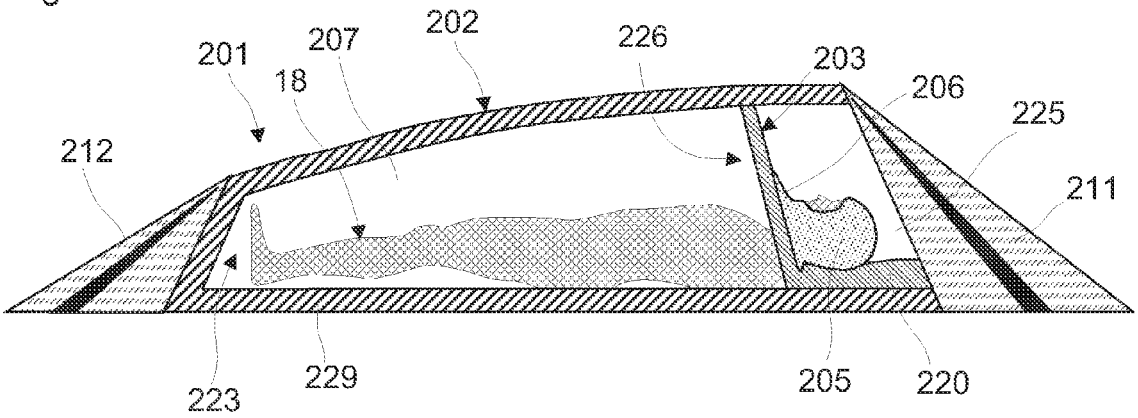
FIG. 9*a* is a sectional elevation view of a further embodiment of a bivouac shelter according to the invention.
Figure 9B:
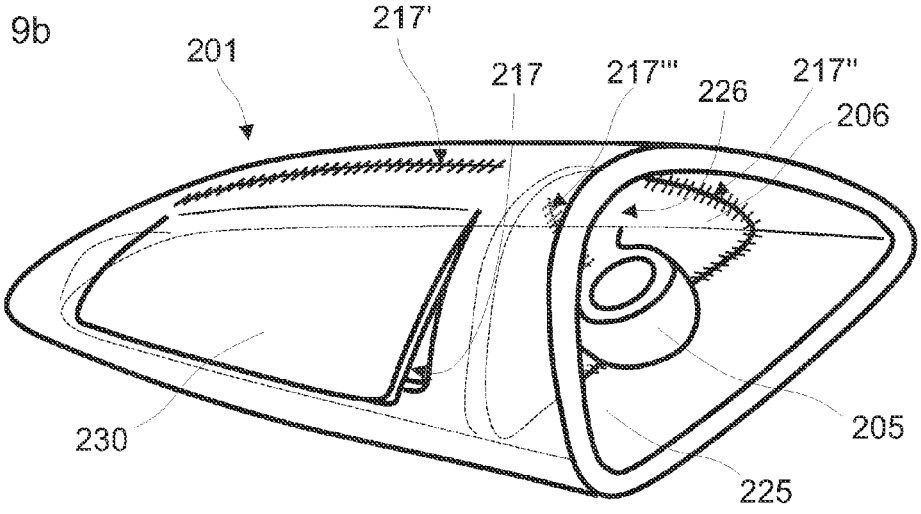
FIGS. 9*b*-9*c* are perspective views of a further embodiment of a bivouac shelter according to the invention.
Figure 9C:
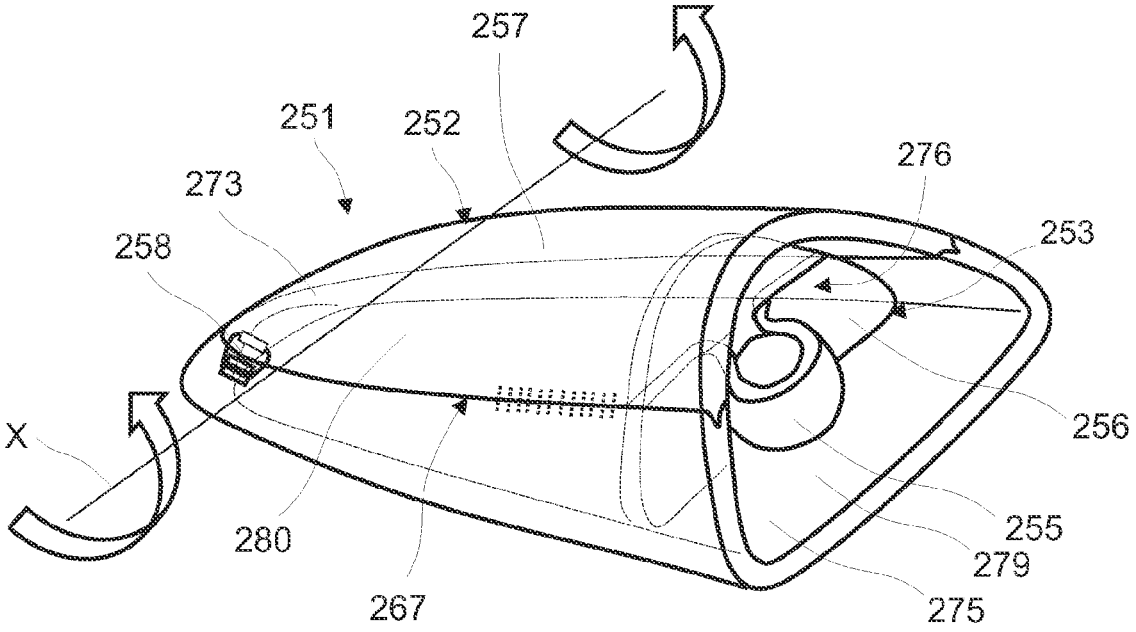

According to the embodiment according to FIGS. 9*a* 9*c*, the body receiving space 207, 257 of the basis unit 202, 252 is closed off to the outside in a thermally insulating and airtight manner at the connection opening 226, 276 by way of the closure unit 203, 253. The closure unit 203, 253 for this is arranged transversely to the longitudinal direction L of the basis unit 202, 252 and transversely to the connection opening 226, 276 which can simultaneously from the access opening 217. The closure unit 203 is moreover arranged set back towards the foot region 233, 275, so that a tunnel-like receiving section 225, 275 which is open at the face side and which receives the head of the user 18 is formed.

The closure unit 203, 253 is designed as a flexible, sheet-like sealing element 206, 256 with a hood 205, 255 which spans the connection opening 226 276. Suitable, flexible, sheet-like materials are already described with respect to the embodiment according to FIGS. 1 and 2 as well as in the general description part.

The sealing element 206 can itself comprise a closable opening 217" which e.g. serves as hand opening (see FIG. 9*b*). The sealing element 206 can furthermore be connected to the basis unit 202 in a fixed which is to say integral manner or via a releasable connection.

Here too, the ground part 229, 279 extends up to the head portion, wherein the head can be supported via a e.g. integrated head underlay 220.

A further awning 211 can be provided subsequently to the ground part 229 (see FIG. 9*a*) at the head side. The head-side and foot-side awnings 111, 112, 211, 212 according to the embodiment examples according to FIGS. 8*a*-9*a* can moreover be provided for the purposes already mentioned above.

Variants of the access openings 217, 217', 217", 217'" are now represented in FIG. 9*b* and these are shown by way of example and by way of the same basis unit 202.

If the sealing element 206 is connected to the basis unit 202 in a releasable manner, then this releasable connection can also form the access opening 217". For this, the user firstly gets into the body receiving space 207 and subsequently fastens the sealing element 206 on the basis unit 102.

If the sealing element 206 has itself a closable opening, then this can not only be designed as a hand opening, but as an access opening 217'".

Moreover, an access flap 230 can be provided on the basis unit 202 itself and can be separated at least partly from the remaining basis unit 202 via a releasable connection, amid the formation of an access opening 217. The basis unit 202 however as an access opening 217' can however also only have a releasable connection which releases an opening slot or opening gap in the opened condition.

The releasable closures which are mentioned above can be zip closures, Velcro-type closures, button closures or combined closures.

FIG. 9*c* shows a further variant of an access opening 267 on a basis unit 252 of a bivouac shelter 251. The bivouac shelter 251 with the exception of the mentioned access opening 267 is designed analogously to the embodiment according to FIGS. 9*a*, 9*b*.

The basis unit 252 comprises a shell-like, removable basis upper part 280. The basis upper part 280 can be lifted from the remaining basis unit 252 in manner departing from the head region towards the foot region, via the direction shown by the arrows. The user can get into the body receiving space 257 and climb out of this again via an upper access opening 267 which becomes free and which lies opposite the ground part 279, by way of removing the basis upper part 280. The basis upper part 280 can be connected with a positive fit to the remaining basis unit 252 via a type of tongue-and-groove connection and be locked on this unit by way of additional fastening means (e.g. clip-lock). The basis upper part 280 can be completely separated from the remaining basis unit or be connected to this via a hinge connection.

The hollow chambers of the multi-walled basis unit 102, 202 are filled with air for setting up the bivouac shelter 101, 201, 251 and for creating the operating position, wherein the multi-wall structure swells up and ensures its intrinsic stability.

Figure 10A:
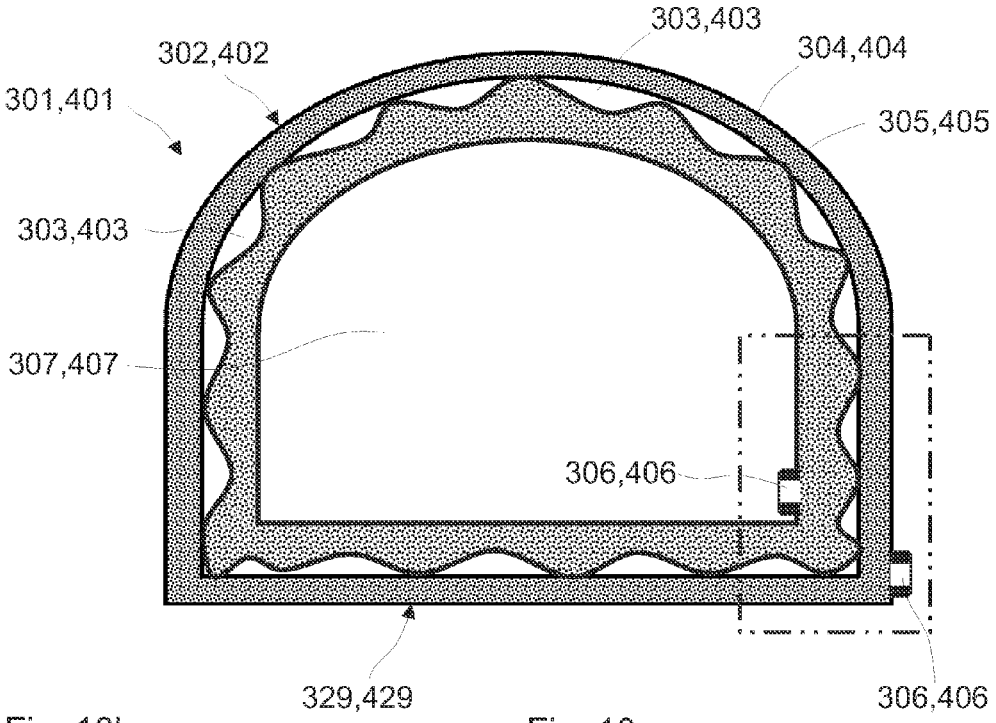
FIGS. 10*a*-10*c* are cross-sectional elevation views through the basis unit of a further embodiment of a bivouac shelter according to the invention.

FIG. 10*a* shows a cross-sectional view through one possible embodiment of a basis unit 302, 402 of a bivouac shelter 301, 401 according to the invention, as can be applied for example in the embodiment variants according to the FIGS. 1 to 9.

The basis unit 302, 402 comprises an inner (insulating) body 305, 405 as well as an outer (insulating) body 304, 404. The inner insulating body 304, 305 forming a tunnel-like or tubular body receiving space 307, 407 can be inserted into the outer insulating body 304, 404. The outer insulating body 304, 404 in any case bears on the inner insulating body 305, 405 and envelops this at least partly and preferably completely. Air filled hollow chambers 303, 403 which are closed or connected to one another are arranged between the two insulating bodies 304, 404; 305, 405. These have a further insulation effect. The inner insulation body 305, 405 for this has a corrugated outer contour. The mentioned outer contour can also be zigzag-shaped or square-wave shaped. The two insulation bodies 305, 405 moreover form a ground part 329, 429.

Both insulation bodies 304, 404; 305, 405 are designed in a multi-walled manner with one or more air-filled hollow chambers 308, 408; 310, 410 which lie therebetween. The insulation bodies 304, 404; 305, 405 comprise valves 306, 406, with which the hollow chambers 308, 408; 310, 410 can be filled with air.

Figure 10B:
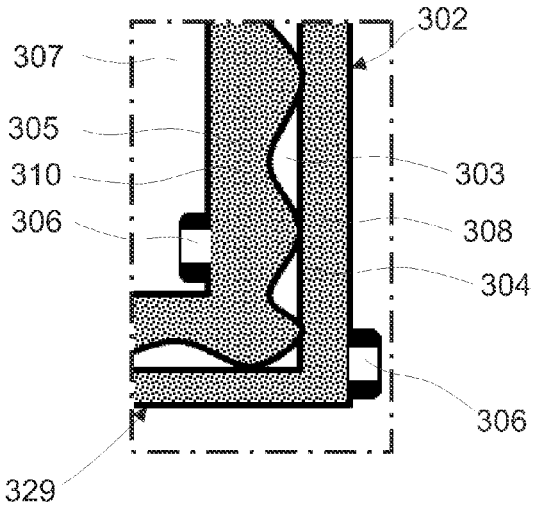
Figure 10C:
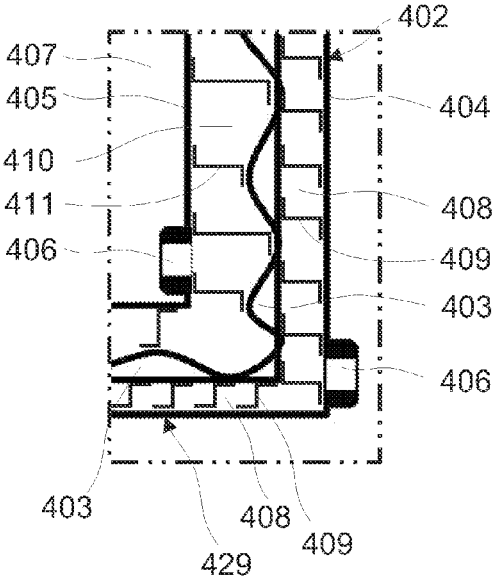

The FIGS. 10*b* and 10*c* in each case show an enlarged detail of a corner region of the basis unit 302, 402 according to FIG. 10*a*. Whereas the outer contour is essentially the same, FIGS. 10*b* and 10*c* describe two different embodiment variants with regard to the inner structure of the insulating bodies 304, 404; 305, 405.

According to the embodiment variant according to FIG. 10*b*, the two insulating bodies 304, 305 comprise two outer outside walls which are distanced to one another, as well as a self-expanding inner structure with at least one hollow chamber which with a pressure relief expands e.g. elastically into an operating position and sucks air through the valve 306 by way of this. The filling of the hollow chamber with air is thus effected without any active feeding of air. This principle is known from self-inflatable air mattresses. The inner structure here is of an elastically deformable foam. The hollow chambers are formed by way of the open pores of the foam.

According to the embodiment according to FIG. 10*c*, the two insulation bodies 404, 405 comprise two outer outside walls which are distanced to one another. The outside walls are connected to one another via flexible connection webs or chamber walls 409, 411 which lie therebetween. These form one or more open or closed hollow chambers 408 which are fillable with air via valves 406. The insulation bodies 404, 405 according to this embodiment must here be actively inflated, e.g. by way of a pump.

The shape retention here is effected essentially via the air volume enclosed in the hollow chambers. The air according to this embodiment variant specifically preferably has an excess pressure compared to the ambient pressure.

The basis unit can moreover comprise a reflecting coating which reflects the body heat into the body receiving space, on the inner side to the body receiving space.

The invention claimed is:

1. A bivouac shelter for residing outdoors or in non-heated accommodation, said bivouac shelter comprising a basis unit with a ground part and a roof part with lateral wall sections, which are connected to the ground part, wherein the basis unit forms a tunnel-shaped or tubular body receiving space with a foot region at least for receiving legs or parts thereof of a lying person and with at least one access opening for the person entering, wherein the basis unit comprises a connection opening lying opposite the foot region which corresponds to an end-side opening of the receiving space, and a closure unit being attached onto the connection opening in a releasable or fixed manner, and the closure unit comprises a flexible sealing element, wherein the sealing element at least partly spans the connection opening, wherein the closure unit is designed for closing off the body receiving space in a thermally insulating and watertight manner, wherein a head of the person can be placed outside the body receiving space closed off by the closure unit, and the basis unit is designed in a self-supporting manner in the operating position and forms the tunnel-shaped or tubular body receiving space, wherein the basis unit comprises an at least partly multi-walled construction with at least one air-filled hollow chamber lying therebetween, and the basis unit obtains its intrinsic stability due to the multi-walled construction or due to the roof part with reinforcement structures that are separate or integrated into the roof part.

2. The bivouac shelter according to claim 1, wherein the connection opening corresponds to the access opening.

3. The bivouac shelter according to claim 1, wherein the closure unit is connected to the basis unit in a releasable manner via a closure device, said closure device being selected from the group consisting of a positive fit, friction fit, a Velcro-type closure, zip closure or button closure.

4. The bivouac shelter according to claim 1, wherein the closure unit comprises a hood of a flexible material for receiving the head of the person.

5. The bivouac shelter according to claim 1, wherein the closure unit consists of a jacket-shaped pull-over part with arms.

6. The bivouac shelter according to claim 1, wherein the body receiving space in the foot region is closable or closed in a thermally insulating and watertight and/or airtight manner via a terminating element that is designed separately or as an integral part of the basis unit.

7. The bivouac shelter according to claim 1, wherein the basis unit in the operating position has a first, outer-lying, tunnel-shaped or tubular body as well as a second, inner-lying, tunnel-shaped or tubular body that forms the body receiving space, wherein the at least one hollow chamber is formed between the first and the second body, and wherein the two bodies are designed in a multi-walled manner with at least one hollow chamber.

8. The bivouac shelter according to claim 6, wherein the basis unit and the terminating element are designed at least double walled over a whole periphery, with one or more of the hollow chambers which lie therebetween and which are filled with air in the operating position.

9. The bivouac shelter according to claim 1, wherein the body receiving space of the basis unit is designed for receiving the body of one or more persons.

10. The bivouac shelter according to claim 1, wherein the closure unit comprises a hood that can be attached onto the sealing element or is integrally attached thereon.

11. The bivouac shelter according to claim 10, wherein the sealing element and/or the hood has rubber-elastic characteristics, and is formed from a natural or synthetic rubber.

12. The bivouac shelter according to claim 2, wherein the closure unit comprises a peripheral, annular connection body for connecting to the basis unit, and the annular connection body comprises one or more inflatable chambers.

13. The bivouac shelter according to claim 1, wherein the closure unit is arranged displaced inwards towards the foot region in the longitudinal direction, so that the basis unit forms an outer-lying, tunnel-shaped receiving section, in which the head of the person, which has been inserted into a hood, can be positioned.

14. A modular bivouac shelter, comprising a basis unit forming a body receiving space and an open receiving section, wherein the body receiving space and the open receiving section of the basis unit are coherent, so that the bivouac shelter is useable as an open camp;

the bivouac shelter comprises a closure unit that is connectable to the basis unit and spatially delimits the body receiving space from the open receiving section, so that the bivouac shelter can be used as a sleeping envelope, the closure unit corresponds to an end-side opening of the body receiving space, the closure unit comprises a flexible sealing element, wherein the sealing element at least partly spans a connection opening of the basis unit, wherein the closure unit is designed for closing off the body receiving space in a thermally insulating and watertight manner, wherein a head of a person can be placed outside the body receiving space closed off by the closure unit;

the bivouac shelter comprises a tent unit that in the assembled condition spans the open receiving section of the basis unit, so that the bivouac shelter is useable as a tent.

15. The bivouac shelter according claim 1, wherein the closure unit further closes off the body receiving space in an airtight manner.

* * * * *